United States Patent [19]

Reece

[11] Patent Number: 4,562,755

[45] Date of Patent: Jan. 7, 1986

[54] INSTALLATION TOOL FOR STUD/INSERT WITH LOCK RING

[75] Inventor: Marvin P. Reece, Dana Point, Calif.

[73] Assignee: Rexnord Inc., Brookfield, Wis.

[21] Appl. No.: 596,227

[22] Filed: Apr. 3, 1984

[51] Int. Cl.[4] ..... B25B 13/50

[52] U.S. Cl. ..... 81/53.2; 81/13

[58] Field of Search ..... 81/13, 53.2, 54; 29/240, 283.2

[56] References Cited

U.S. PATENT DOCUMENTS

| | | | |
|---|---|---|---|
| 2,125,005 | 7/1938 | Jearum . | |
| 2,550,866 | 5/1951 | Rosan . | |
| 2,790,342 | 4/1957 | Rosan . | |
| 2,929,134 | 3/1960 | Mosher | 29/240 |
| 2,947,208 | 8/1960 | Neuschotz . | |
| 3,245,137 | 4/1966 | Neuschotz et al. | 81/53.2 X |
| 3,322,005 | 5/1967 | Neuschotz . | |
| 3,388,621 | 6/1968 | Neuschotz . | |
| 3,390,597 | 7/1968 | James | 81/53.2 |
| 3,555,649 | 1/1971 | Rigot et al. . | |
| 3,574,915 | 4/1971 | Stevenage . | |
| 3,740,814 | 6/1973 | Marshall | 81/53.2 X |
| 4,361,943 | 12/1982 | Kobusch | 29/240 |

OTHER PUBLICATIONS

"Maintenance Handbook for the BG1750–BG2500 Blind Fastener Guns", pp. 32–49, Copyrighted 1977, Hi-Shear Corporation, Torrance, CA.

*Primary Examiner*—James G. Smith

[57] ABSTRACT

A tool for installing studs or inserts into a threaded hole in a workpiece includes a power unit having a housing with a threaded nose and a spindle which can be rotated and axially pulled under power in the threaded nose. An adapter mounted on the power unit nose has a drive member which is coupled to the spindle for screwing the insert into the threaded hole and then pulling on the insert which causes a reaction sleeve to force a lock ring into the workpiece around the insert. An adapter for the stud includes a drive member having an internally threaded nut which is adjustable along its length and which is used to screw the stud into the threaded hole and then pull axially on the stud which forces the reaction sleeve to drive the lock ring into the workpiece around the stud. The insert engages a shoulder on the drive member, and the lock ring is accurately located on the drive member relative to the insert so that the top surface of the installed insert is just flush with, or slightly below, the top surface of the workpiece.

1 Claim, 6 Drawing Figures

INSTALLATION TOOL FOR STUD/INSERT WITH LOCK RING

BACKGROUND OF THE INVENTION

This invention relates to an installation tool for an externally threaded insert or stud which is locked to the workpiece by a serrated lock ring.

The inserts and studs which this tool was designed to install are the type shown in U.S. Pat. Nos. 3,630,252 for "Stud Fastener Assembly with Integral Lockring," 3,404,415 for "Method of Making Fastener with Snap On Captive Locking Ring," 3,259,162 for "Insert with Frictionally Interlocked Locking Ring," 3,259,161 for "Fastener with Captive Locking Ring" and the like. These inserts and studs are used to provide a strong and hard threaded receptacle for fasteners in soft material, for repairing a workpiece which has been bored incorrectly, and for providing a securely locked stud for fastening other components to a workpiece. The lock ring on the fasteners disclosed in these patents is an internally and externally serrated ring of hard material that meshes with a serrated bourrelet on the stud or insert and is driven into the peripheral edge of the hole in which the insert is threaded to torsionally lock the insert or stud to the workpiece. The external serrations torsionally lock the lock ring to the workpiece, and the internal serrations of the lock ring meshing with the serrations on the bourrelet on the stud/insert lock it to the lock ring.

At present there are two methods for installing these stud/inserts: manually, and with installation tools. They can be manually installed by threading the insert into the threaded hole in the workpiece to the proper depth, and then manually locked in the workpiece by placing the lock ring on the top of the serrated bourrelet and hammering it into the peripheral lip of the bore. This is a suitable installation technique only when there are a few inserts to be installed in a nonproduction-type assembly or repair project. For most production work, installation tools are the only economically feasible method of installing the stud/inserts because of the time and fatigue factor in the manual technique.

The prior art installation requires the use of two power driven tools. The first is a rotating tool, similar to a power screwdriver, which engages the serrated bourrelet and screws the insert/stud into the threaded hole in the workpiece. The tool is then removed from the stud/insert and a lock ring is placed on the serrated bourrelet. A second tool is fitted in place on the lock ring and hammers the lock ring into the peripheral rim of the bore.

Although this system has worked well enough in the past, it is subject to several disadvantages. The use of two tools is somewhat inconvenient and slow because one tool must be removed and put down and the second tool picked up and fitted in place which is time consuming in the context of a high production operation. In addition, this operation is somewhat fatiguing to the worker because it requires a good deal of manipulation of these installation tools and the hammering of the lock ring into the workpiece is quite noisy and, depending on the workpiece involved, the use of the lock ring hammering tool may actually require hearing protection. Finally, it is not always possible to get the exact desired depth of the insert with the two-tool system. The stud/insert should be threaded into the hole in the workpiece until the top of the serrated bourrelet is just flush with or within about 0.010" below the top surface of the workpiece. This is a difficult precision to achieve with the prior art tools and requires considerable attention on the part of the operator to attain the exact desired depth of the stud/insert.

There is one tool that has been designed for installation of inserts only. It is the subject of U.S. Pat. No. 3,385,378 and it is a satisfactory tool, but is somewhat complicated and expensive, cannot be used to install studs, and hammers the lock ring into the workpiece.

OBJECT OF THE INVENTION

Accordingly, it is an object of this invention to provide a single tool that is capable of screwing both studs and inserts into a threaded hole, pressing the lock ring into the workpiece, and then unscrewing itself from the stud/insert. It is another object of the invention to provide a single tool for installation of both studs and inserts, that is quiet in operation, produces consistent results, and improves productivity. Finally, it is an object of this invention to provide a single tool for installation of both studs and inserts, that can be adapted to install a wide variety of stud/inserts by simple adjustment or change of adapters for the tool.

These objects are attained in the preferred embodiment of a tool having adapters for installing both studs and inserts. The tool includes a power unit having a housing with a threaded nose, and having a spindle which can be rotated and axially retracted under power relative to the threaded nose. The insert adapter has a drive member which is coupled to the spindle for screwing the insert into the threaded hole and then pulling on the insert which causes a reaction sleeve to force the lock ring into the workpiece around the insert. The adapter for the stud includes a drive member having an internally threaded nut which is adjustable along its length and which is used to screw the stud into the threaded hole and then pull axially on the stud which forces the reaction sleeve to drive the lock ring into the workpiece around the stud, in the same manner that the lock ring is driven into the workpiece around the insert.

DESCRIPTION OF THE DRAWINGS

The invention and its many attendant objects and advantages will be better understood by reference to the following description of the preferred embodiment when read in conjunction with the following drawings, wherein.

DESCRIPTION OF THE PREFERRED EMBODIMENT

Figure 1:
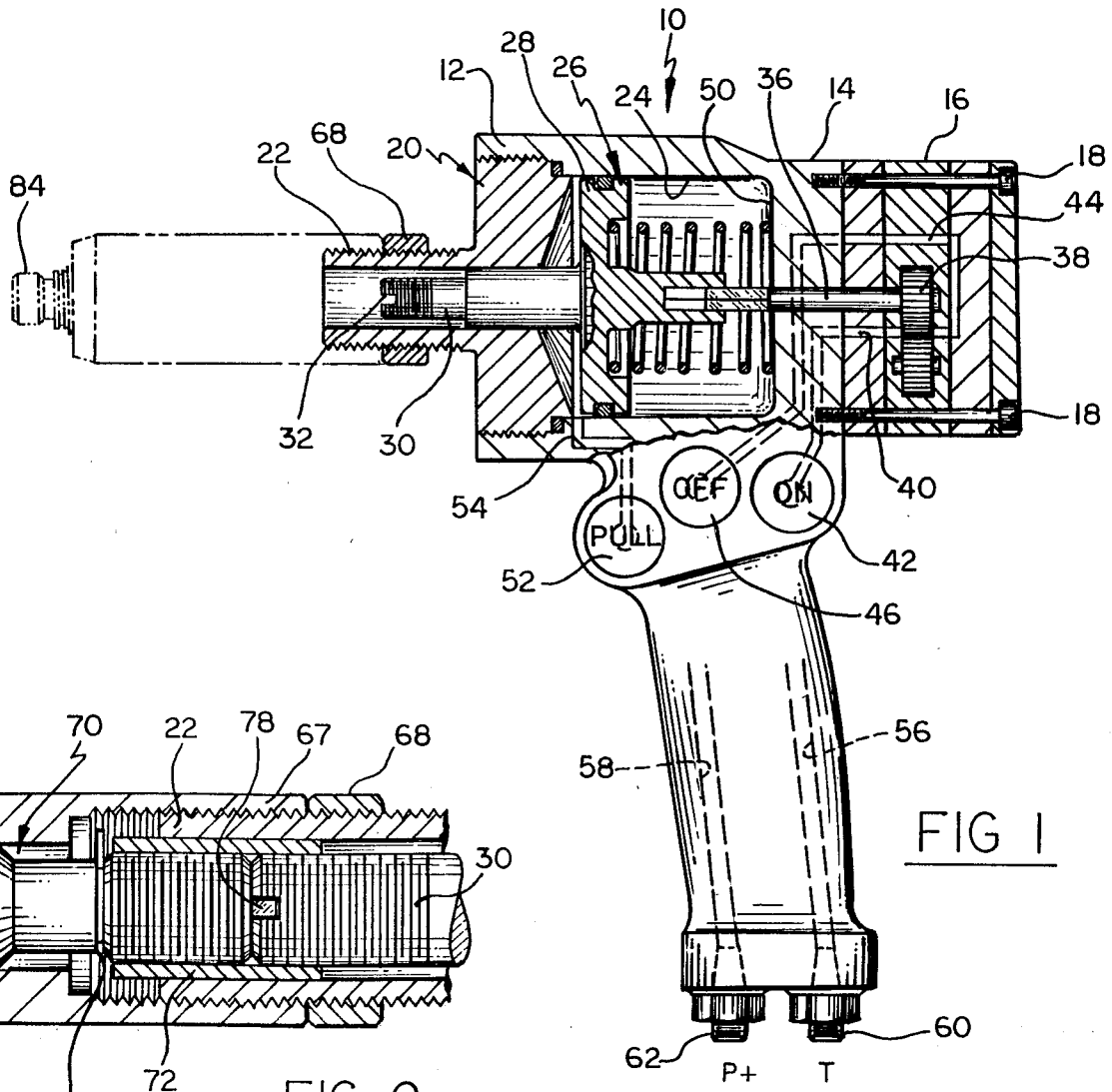
FIG. 1 is a sectional elevation of a hydraulically powered tool in accordance with this invention.

Referring now to the drawings wherein like or primed reference characters designate identical or corresponding parts, and more particularly to FIG. 1 thereof, a hydraulically operated power unit is shown having the ability to rotate a threaded spindle in either direction, and to pull the spindle axially toward the rear of the power unit with a predetermined force. As used herein, the rear of the power unit is the right-hand end in FIG. 1, and the front is the left-hand end in FIG. 1. Three buttons on the body of the tool control the spindle rotation in clockwise and counterclockwise direction, and the axial pull on the spindle.

The power unit includes a housing 10 having a cylindrical front portion 12 and a square rear portion 14 to which a hydraulic motor 16 is attached by screws 18. The cylindrical front portion 12 is in the form of a forwardly opening barrel which is internally threaded at its front end, and receives an externally threaded closure 20 having a forwardly extending externally threaded nose 22. The cylindrical front end portion 12 of the housing 10 has an internal cylindrical cavity 24 in which is received an actuator 26 which includes a piston 28 and a forwardly extending spindle 30 in the forward end of which is formed a mortise 32. A square hole 34 is formed in the actuator 26 coaxial with its longitudinal axis and opening to the rear.

A square ended drive shaft 36 is attached to one of the gears 38 of a gearotor hydraulic motor of conventional design that can be driven in a clockwise direction by pressurized hydraulic fluid delivered through an internal duct 40 controlled by a button control 42, and can be driven in a counterclockwise direction by pressurized hydraulic fluid delivered on the other side of the gearotor hydraulic motor through a duct 44 controlled by a control button 46. The gearotor hydraulic motor 16 is engaged with the actuator 26 by the square end of the drive shaft 36 engaged in the square hole 34 in the actuator. The shaft 36 rotates the actuator 26 but the axial movement of the actuator in the cavity 24 is controlled by the hydraulic fluid pressure in the cavity 24 forward of the piston 28, and by a spring 48 compressed between the rear face of the piston 28 and the rear end 50 of the cavity 24.

The hydraulic fluid pressure in the cavity 24 in front of the piston 28 is controlled by a control button 52 which admits hydraulic fluid under pressure through a duct 54 into the cavity 24 forward of the piston 28. The button controls 52, 46 and 42 are all spring loaded buttons which control slide valves which, in their normal undepressed position, connect the ducts 54, 44 and 40, respectively, to a duct 56 leading to a connector 60 to which is connected a fluid line leading to a fluid reservoir or tank (not shown). The control buttons in their depressed condition connect the ducts 54, 44 and 40 to a duct 58 leading to a connector 62 to which is connected a pressure line leading to a source of pressurized hydraulic fluid (not shown). The source of pressurized hydraulic fluid can be set to deliver hydraulic fluid at any desired pressure within a certain range to control torque exerted on the spindle by the motor 16, and control the mechanical force exerted by the piston on the spindle 30 so that the force exerted by the power unit is controllable.

Figure 2:
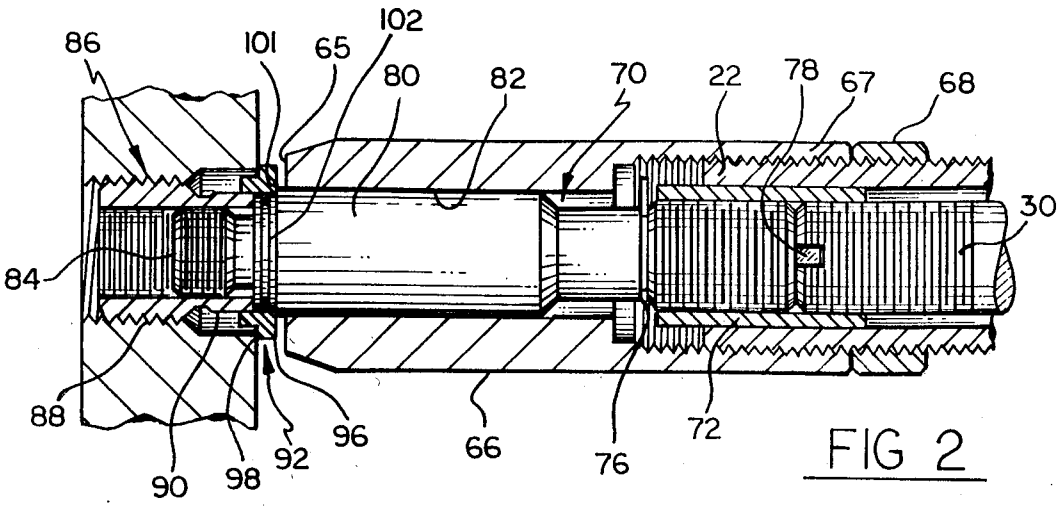
FIG. 2 is a sectional elevation of one adapter for the tool shown in FIG. 1 for installation of inserts.
Figure 2A:
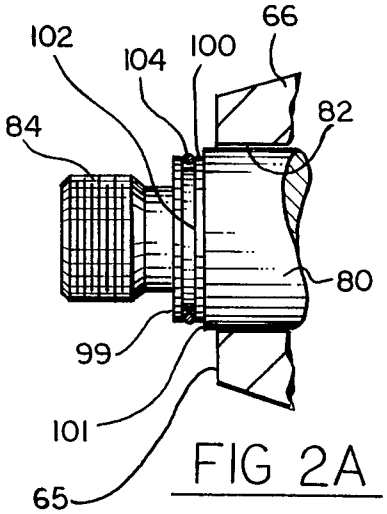
FIG. 2A is a partial sectional elevation of the front end of the adapter shown in FIG. 2 with the insert removed.

FIG. 2 illustrates an adapter for installing an insert using the power unit shown in FIG. 1. The adapter includes a cylindrical reaction sleeve 66 having a flat front end 65 defining an annular press face lying in a plane perpendicular to the axis of the sleeve 66, and having an internally threaded rear end 67 which is threaded to the forward end of the threaded nose 22 of the power unit. An internally threaded locking ferrule 68 threaded onto the threaded nose 22 of the power unit to lock before the reaction sleeve is screwed on, can be screwed down tight against the end 67 of the reaction sleeve 66 to jam its threads on the threaded nose the reaction sleeve 66 at the preselected axial position along the threaded nose 22.

A drive member in the form of a cylindrical arbor 70 is telescopically received in the reaction sleeve 66 and is coupled to the forward end of the spindle 30 by a coupling bushing 72. The busing 72 provides axial coupling to enable the spindle 30 to exert an axial pull on the arbor 70, and also ensures that the spindle and arbor will remain torsionally engaged. The rear end of the arbor 70 has formed thereon a tenon 78 which engages the mortise 32 at the forward end of the spindle 30 to provide torsional coupling between the spindle 30 and the arbor 70.

The mid-section of the arbor 70 includes a cylindrical body 80 which fits closely within the bore 82 of the reaction sleeve 66. The close fit of the reaction sleeve on the cylindrical body 80 provides a precise guidance of the axial movement between the reaction sleeve 66 and the arbor 70, to be explained below.

At the forward end of the arbor 70 is a reduced diameter externally threaded stub 84 sized to threadedly engage the threaded interior bore of an insert 86. For reference, the left-hand end of the insert 86 in FIG. 2 and the stud 86′ in FIG. 3 will be denoted the "bottom," and the right-hand end will be denoted the "top." The insert 86 has an internally and externally threaded base 88 and a serrated bourrelet 90 at the top end of the base 88. A lock ring 92 is provided to lock the insert 86 into the workpiece. The lock ring 92 is either a loose, separate part, or is fixed in place on the insert, for example, as shown in U.S. Pat. No. 3,259,163. The lock ring 92 has internal serrations which mesh with the external serrations of the bourrelet 90, and has external serrations 96 formed partially or fully around its outside periphery. The bottom edge 98 of the external serrations 96 on the lock ring 92 are sharp and form a serrated cutting edge having an angle less than 90° so as to cut cleanly into the periphery of the hole into which the lock ring will be forced.

Between the cylindrical body 80 of the arbor 70 and the reduced diameter forward stub 84 on which the threads are rolled, a slightly reduced diameter step 100 is turned into the cylindrical body to produce a first shoulder 99 at the junction of the forward stub 84 and the step 100, and a second shoulder 101 at the junction of the step 100 and the cylindrical body 80. The step 100 serves as a ring mount onto which the lock ring 92 can be pulled and retained while the insert 86 is screwed into the threaded hole in the workpiece. The axial distance between the first shoulder 99 and the second shoulder 101 is such that when the insert is screwed into the hole until the bottom edge 98 of the serrations 96 contact the workpiece, the top surface of the serrated bourrelet 90 will be flush with or at most 0.010 inches below the top surface of the workpiece. This ensures precise and consistent results achieved by use of the tool. A groove 102 is turned into the cylindrical surface of the step 100 and receives a spring retaining ring 104 for holding the lock ring 92 in place on the step 100.

In operation of the attachment shown in FIG. 2 on the power unit shown in FIG. 1, an insert 86 is held in position against the threaded stub 84 and the "on" button 42 is pushed which causes the spindle 30 to drive the arbor 70 in a clockwise direction so that the threaded stub 84 threads into the threaded bore of the insert 86 until the top of the serrated bourrelet 90 engages the first shoulder 99. If the insert is of the captive lock ring type in which the lock ring is adhered to or force fit on the serrated bourrelet 90, then the top of the lock ring 92 will already be near or against the second shoulder 101. If the insert is of the loose lock ring variety, then the lock ring 92 is pulled up onto the step 100 with the top surface of the lock ring in engagement with the second shoulder 101, and the spring retaining ring 104 will hold the lock ring in place with the bottom region of its internal serrations just meshing with the top region of the external serrations on the serrated bourrelet 90.

The tool is then positioned to place the insert 96 in the counterbore in the hole in the workpiece and the "on" button 42 is again pushed which causes the spindle 30 to turn the arbor 70 in a clockwise direction which threads the insert 86 into the hole in the workpiece until the bottom edge 98 of the external serrations on the lock ring engages the peripheral edge of the hole, as shown in FIG. 2. The "on" button is then released and the "pull" button 52 is pushed which admits hydraulic fluid under pressure through the duct 54 into the chamber 24 in front of the piston 28. This causes the piston 28 to retract, to the right in FIG. 1, and pull the spindle back through the threaded nose 22 of the power unit. Since the reaction sleeve 66 is threadedly engaged with the threaded nose 22, the effect is a relative axial movement between the arbor 70 and the reaction sleeve. Since the arbor 70 is axially fixed by virtue of its threaded engagement with the interior of the insert 86, the effect is for the reaction sleeve 66 to advance forward against the lock ring 92, driving it smoothly into the peripheral edge of the hole in the workpiece. The forward movement of the reaction sleeve 66 against the lock ring 92 is smooth, controlled, and quiet. The force can be set to be just sufficient to cause the lock ring to enter the parent material of the workpiece without causing excessive strain of the insert in the threads in the hole in the workpiece.

Figure 3:
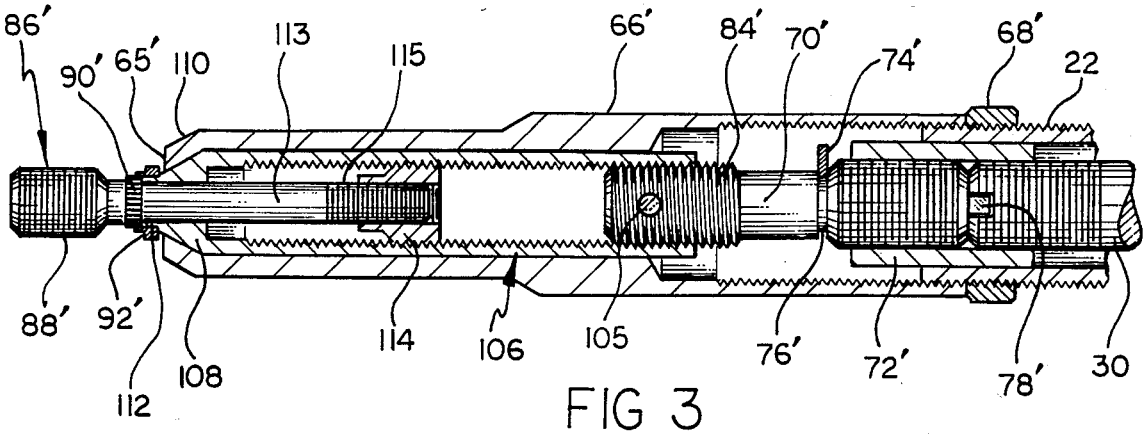
FIG. 3 is a sectional elevation of an adapter for the tool shown in FIG. 1 for installation of studs.

Turning now to FIG. 3, a second adapter for the power unit shown in FIG. 1 includes a reaction sleeve 66' which is internally threaded at its back end and is threaded onto the threaded nose 22 of the power unit. A locking ferrule 68', previously threaded onto the threaded nose 22, is turned against the end of the reaction sleeve 66' to jam the threads and hold the reaction sleeve 66' axially in place on the threaded nose 22 so that it does not turn in operation and change the setting of the adapter.

An arbor 70' is coupled to the spindle 30 by a threaded coupling bushing 72' which is threaded onto the forward end of the spindle 30 and the rear end of the arbor 70' in the same manner as that shown for the adapter in FIG. 2. The rear end of the arbor 70' includes a rearwardly extending tenon 78' which fits into the mortise 32 of the spindle 30 to provide torsional engagement between the arbor 70' and the spindle 30 in the same manner as that shown in FIG. 2. An E-ring 74' is snapped into a groove 76' in the mid-section of the arbor 70' to prevent the coupling bushing 72' from screwing itself forward off of the spindle 30.

Figure 4:
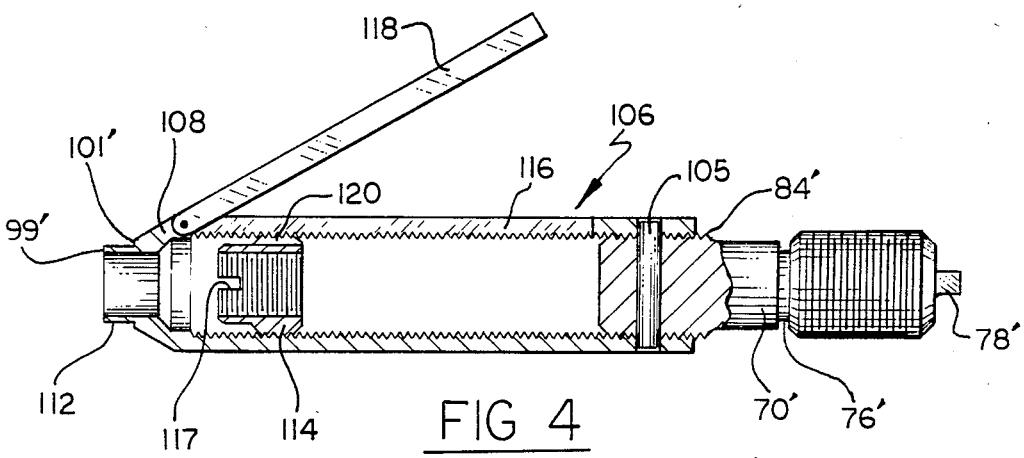
FIG. 4 is a sectional elevation of the drive member for the adapter shown in FIG. 3.
Figure 2B:
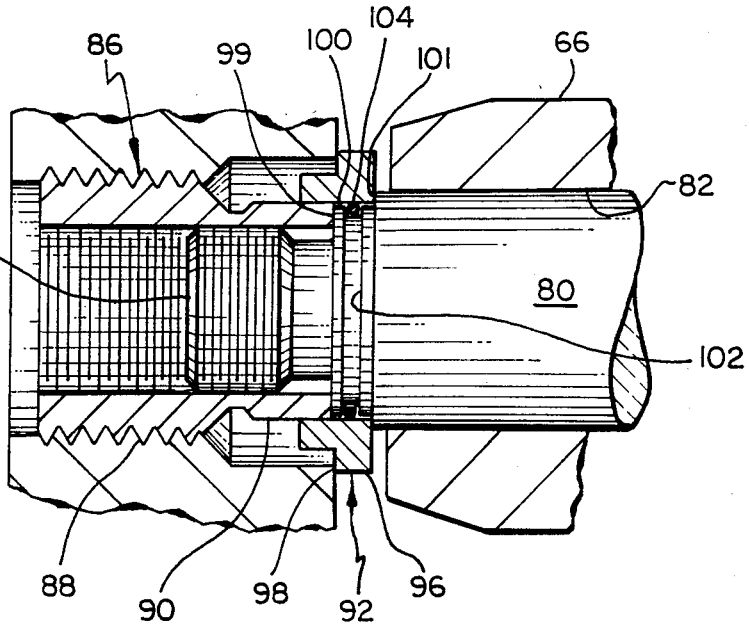
FIG. 2B is an enlargement of the front end of FIG. 2.

The forward end of the arbor 70' is roll threaded and forms a threaded stub 84' which is threadedly engaged into an internally threaded bore of a mandrel 106 and pinned therein with a pin 105. The mandrel 106 is slidably received in the cylindrical bore of the reaction sleeve 66'. The mandrel is cylindrical for almost its entire length but the front end 108 is tapered to correspond to the internal taper of the front end 110 of the reaction sleeve to form a stop for the mandrel 106 in the reaction sleeve. The forwardmost end of the mandrel 106 forms a ring mount 112 for a lock ring 92'. The ring mount in the embodiment of FIGS. 3 and 4 is a thin serrated collar onto which the lock ring 92' can be pulled with a snug fit so as to retain it in position. The thickness of the serrated collar 112 is such as to fit between the shank 113 of the stud 86' and the serrations on the inside diameter of the lock ring 92'.

An internally and externally threaded socket 114 is provided within the mandrel 106 to threadedly engage the threaded end 115 of the stud shank 113. The axial position of the socket 114 can be adjusted to accommodate a wide variety of stud lengths. The adjustment is made by inserting a key wrench into the forward end of the socket 114 which is internally broached with a pair of diagonally opposed keyways 117 to receive the key wrench, and is merely rotated until it advances or retracts on the internal threads in the mandrel bore to the desired position. For ease in adjusting the position of the socket 114 along the mandrel 106, a series of indicia are inscribed along a slot 116 in the mandrel to guide the worker making the adjustment. The longitudinal slot 116 is milled in the mandrel for almost the entire length of its cylindrical portion down to the region where the threaded stub 84' threads into the end of the mandrel 106. A key 118 is pinned at the forward end of the slot 116 and is dimensioned to protrude slightly into the interior of the mandrel when it is folded down into the slot 116. The key fits into a corresponding longitudinal slot 120 formed in the exterior surface of the socket 114 to lock the socket against rotation in the threaded bore of the mandrel 106 when the key is folded down into the slot 116.

In operation, a stud 86' having a shank portion 113 of a certain length is selected and the socket 114 is adjusted axially along the mandrel to the position corresponding to the length of the stud shank. The slot 120 in the socket 114 is aligned with the slot 116 in the mandrel 106 and the key 118 is folded down about its pinned end on the mandrel into the slot 116 and extending into the slot 120 of the socket 114, thereby locking the socket 114 against rotation in the threaded bore of the mandrel 106 so that the axial position of the socket 114 is fixed. The reaction sleeve 66' is then threaded onto the threaded nose 22 of the power unit and the locking ferrule 68' is screwed down tight against the rear end of the reaction sleeve 66' to hold it in position. A stud 86' is inserted in the forward end of the mandrel 106, and the threaded end 115 of the stud shank 113 is threaded into the socket 114 by pressing the "on" button 42 until the serrated collar 112 on the forward end of the mandrel 106 butts against the serrated bourrelet 90' on the stud 86'. A serrated lock ring 92', which had previously been placed on the stud, is pulled up onto the serrated collar 112 with the bottom end of the lock ring 92' jsut meshing with the serrations on the serrated bourrelet 90'.

The power unit is then placed into position so that the threaded base 88' of the stud 86' is placed in the counterbore of a threaded hole in the workpiece. With the threaded base 88' of the stud 86' in the counterbore of the threaded hole in the workpiece, the power unit "on" button is again pressed which causes the spindle 30 to rotate in a clockwise direction and cause the mandrel 106 to be driven by the arbor 70' and thereby rotate the stud 86' and screw the threaded base 88' of the stud 86' into the threaded hole in the workpiece. When the bottom edge of the lock ring 92' reaches the top surface of the workpiece, the "on" button is released at which time the to surface of the serrated bourrelet 90' is slightly below the top surface of the workpiece. The "pull" button 52 is then pressed which pressurizes the cavity forward of the piston 28 of the power unit which causes the spindle 30 to be retracted through the threaded nose 22 which causes the reaction sleeve 66' to move forwardly against the lock ring 92' and drive the lock ring into the material of the workpiece in the periphery of the counterbore of the hole. When the forward edge of the reaction sleeve 66' reaches the top surface of the workpiece it will stop, and the "pull" button is released. The "off" button 46 is then pushed which causes the spindle 30 to rotate in a counterclockwise direction thereby unscrewing the mandrel and the threaded socket 114 off the threaded end 115 of the stud shank 113.

Obviously, numerous modifications and variations of the invention disclosed herein will occur to those skilled in the art in view of this disclosure. For example, the socket 114 could be fixed in the mandrel 106 for those who have only one or a few size studs to mount in the workpiece, and the mandrel 106 could be screwed directly to the spindle 30 with the pin serving the function of the tenon of 78'. Thus, it is expressly to be understood that these and other modifications and variations, and the equivalents thereof, may be practiced while remaining within the spirit and the scope of the invention as defined in the following claims.

I claim:

1. An adapter for adapting a power unit having a housing from which projects a fixed nose, in which extends a spindle which can be rotated in either direction and axially retracted under power for installing a stud insert having a threaded base and a serrated bourrelet above the threaded base, and a lock ring having internal serrations adapted to mesh with the serrated bourrelet and external serrations adapted to lock into a workpiece when the lock ring is pressed into the peripheral rim of a hole in said workpiece into which the stud insert is threaded, said adapter comprising:

a reaction sleeve adapted to be mounted on said power unit nose, and having a cylindrical bore coaxial with a spindle of a power unit;

a drive member having a cylindrical body closely fitting within said reaction sleeve bore and rotationally and axially slidable therein and an internally threaded bore;

coupling means for torsionally and axially coupling said drive member with the spindle; and engaging means on said drive member for torsionally and axially connecting said drive member to a stud insert;

said engaging means including an internally and externally threaded socket threaded into said internally threaded bore in said drive member and rotatable therein to adjust its axial position along said drive member so as to accommodate studs of different shank length, said socket being adapted to threadedly engage one threaded end of said stud, said engaging means further including means for releasably fixing said socket against rotation in said drive member bore and to fix the axial position of said socket, said socket fixing means including a longitudinal slot in said drive member, a longitudinal slot in said socket and a key fitted into said drive member slot and projecting radially into said bore and into said corresponding longitudinal slot in said socket;

said drive member further having a shoulder for contacting the top edge of said serrated bourrelet on said insert when said stud insert is fully assembled to said adapter so as to accurately locate said stud insert relative to said drive member, so that when said stud insert is screwed into said workpiece hole until said lock ring seats against the top surface of said workpiece, the top edge of said serrated bourrelet will be within 0.0–0.010 inches below the top surface of said workpiece;

said reaction sleeve having a press face for engaging said lock ring when said spindle is retracted relative to said nose and said nose advances relative to said spindle, thereby forcing said press face of said reaction sleeve against said lock ring to press said lock ring into said workpiece such that the top surface of said lock ring is flush with the top surface of said workpiece.

* * * * *